US008997393B2

(12) United States Patent
Bar Yona

(10) Patent No.: US 8,997,393 B2
(45) Date of Patent: Apr. 7, 2015

(54) AIMING SIGHT WITH A MULTI-FOCAL COLLIMATOR

(71) Applicant: Itzhak Bar Yona, Rosh Haayin (IL)

(72) Inventor: Itzhak Bar Yona, Rosh Haayin (IL)

( * ) Notice: Subject to any disclaimer, the term of this patent is extended or adjusted under 35 U.S.C. 154(b) by 0 days.

(21) Appl. No.: 14/133,645

(22) Filed: Dec. 19, 2013

(65) Prior Publication Data

US 2014/0223797 A1 Aug. 14, 2014

(51) Int. Cl.
*F41G 1/00* (2006.01)
*F41G 1/027* (2006.01)

(52) U.S. Cl.
CPC ..... *F41G 1/027* (2013.01)

(58) Field of Classification Search
CPC ..... F41G 1/38
USPC ..... 42/111–148
See application file for complete search history.

(56) References Cited

U.S. PATENT DOCUMENTS

| | | | | |
|---|---|---|---|---|
| 5,878,503 | A * | 3/1999 | Howe et al. | 42/132 |
| 6,035,539 | A * | 3/2000 | Hollenbach et al. | 42/132 |
| 6,058,615 | A * | 5/2000 | Uhlmann et al. | 42/132 |
| 6,216,351 | B1 * | 4/2001 | Flubacher et al. | 42/145 |
| 6,360,471 | B1 * | 3/2002 | Stein | 42/122 |
| 8,276,283 | B1 * | 10/2012 | Kopacz et al. | 33/297 |
| 2007/0107292 | A1 * | 5/2007 | Bar-Yona et al. | 42/144 |

* cited by examiner

*Primary Examiner* — Samir Abdosh
(74) *Attorney, Agent, or Firm* — Mark David Torche; Patwrite LLC

(57) ABSTRACT

An aiming sight for a firearm. The aiming sight includes: a mounting unit; a light gathering fiber; and a parallax multi-focal lens. When aimed at a target, the aiming sight displays to the shooter a complex light signal having a central dot and a peripheral corona around the dot.

5 Claims, 6 Drawing Sheets

Fig. 1
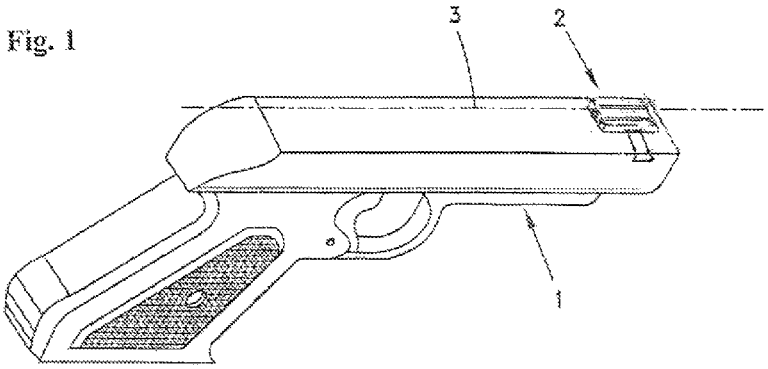
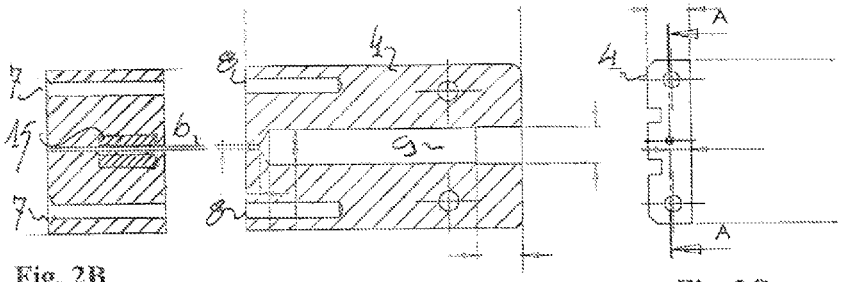
Fig. 2B
Fig. 2C
SECTION A-A
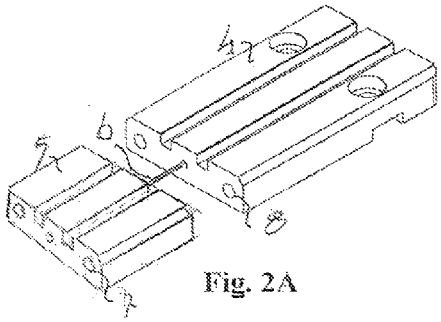
Fig. 2A

AIMING SIGHT WITH A MULTI-FOCAL COLLIMATOR

FIELD OF THE INVENTION

The present invention relates to firearms, in particular to firearm aiming devices.

BACKGROUND OF THE INVENTION

Conventional classical methods of aiming at a target require aiming means having rear and front sights, normally situated on top of the barrel of the firearm. Such means are described for example in U.S. Pat. No. 6,360,471 (Stein); U.S. Pat. No. 6,058,615 (Uhlmann et al); U.S. Pat. No. 6,216,351 (Flubacher et al); and U.S. Pat. No. 6,035,539 (Hollenbach et al), which provide aiming sight solutions for firearms based on a basic idea of aligning both the rear and front sights with the barrel axis and also with the line of sight of shooter and target. However, in methods based on this principle, the shooter is required to align these two spaced apart elements in order to accurately hit the target. This aiming procedure is based on the shooter's best judgment of whether the two elements are perfectly aligned. Such judgment requires essential skills and fractions of seconds of time, which may result in hitting the target or missing the opportunity of shooting first.

A second drawback of the classical spaced apart aiming method relates to the necessity of focusing the eye on three different locations: the first being the proximal sight; the second being the distal part of the sight; and the third being the target. This is a difficult task for any healthy eye and rather impossible for short sighted shooters.

More advanced solutions are available in the form of Reflex Sights (Sometimes called Red-Dot sights), such as those being produced by Aimpoint, Meprolight, or Trijicon, for example. These sights are normally mounted on the rear upper part of the barrel. Looking through the optical part of the sight, the shooter sees a colored dot, which he has to superimpose on the target in order to hit. A similar type of these more advanced sighting systems, this time based on refractive rather than on reflective principles, is provided by GB 2154018 (Cannon). Being friendly for use, they are very expensive, cumbersome systems and which, while looking through the optical part tend to hide a substantial part of the view surrounding the target.

US 2007/107292 (Bar-Yona et al); and U.S. Pat. No. 5,878,503 (Howe) provide aiming devices for guns, including a lenticular component that is seen by the user as having a first color when the aim line has a desired orientation and has at least one second color when the aim line does not have that desired orientation. The optical principle here is based on geometrically locating a shining dot at the focal point of a lens, so that the lens displays to the shooter a first color when his line of sight is directed to this shining focal point, and observes another color when the focal point of the lens falls on the background of the shining dot.

The main drawback of these systems is that they do not provide the shooter with the option for gradually fine-tuning the direction of the gun. This is a consequence of the fact that the replacement of the first color by the second one is total and immediate. This system is actually a kind of trade-off between two contradicting features: a rapid target acquisition on the one hand and sensibility to the color change (for accurate shoots) on the other hand. In other words, if the focal length of the lens is initially increased in order to get a more sensitive color change, the shooter does not perceive any color change until the firearm is almost perfectly aimed at the target. On the other hand, if the focal length is diminished, the color change occurs more gradually, but the sensibility to angular change is diminished.

OBJECTS OF THE INVENTION

The objects of the present invention will be explained with reference to the following definitions:

The term "firearm" and its derivatives relates to weapons such as slug guns, shot guns, hand pistols and rifles as well as grenade launchers, paintball guns/rifles, archery means, and other means requiring aiming means for shooting at a target.

The term "classical spaced apart sight" and its derivatives refers to sighting systems including two non-illuminated spaced apart parts aligned with the barrel of the firearm.

The term "multi focal lens" and it derivatives refers to a lens being divided into two or more different portions, each of these portions having its particular focal point.

One objective of the present invention is to provide an aiming sight that has a rapid target acquisition and is very accurate at the same time.

A second objective of the present invention is to provide an aiming sight for shooters, especially short sighted ones, that only requires observation of two distant landscapes; namely, the target and the distal sight of the firearm.

A third objective of the invention is to provide an aiming sight that is much smaller than the known reflex sights, with which the shooter can observe the surroundings of the target—not through the optical part of the sight, but rather around it, without loosing much of the surrounding view.

SUMMARY OF THE INVENTION

The present invention is an aiming sight intended for mounting on the distal or proximal end of a firearm. The aiming sight includes a light source such as a light gathering fiber, for example, and a parallax multi focal lens, aligned with the barrel, wherein the lens is optically curved in a way so that the shooter perceives a complex light signal, for example a central colored dot and a peripheral corona around it.

When the firearm is perfectly aimed at the target, the central point is located exactly in the middle of the corona. When a deviation from the perfect alignment occurs, a shining focal point is displaced and becomes eccentric relative to the corona following the disappearance of the corona.

Thanks to this complex light signal, a two-step procedure is created. First, perceiving the central point, and second, locating the shining corona around the central point. In the first stage the central point tends to appear within a relatively wide range of angles giving the shooter an initial indication to the target. In the second step fine tuning of the direction is achieved by locating the corona exactly around the central point.

In a preferred embodiment, the light source is a fluorescent (light gathering) optic fiber using ambient light for creating the light signal.

In a second preferred embodiment, an additional light emitting source is added to the fiber optic in a form of Tritium radioactive vials, in such a way that the aiming sight can operate independently from the ambient light.

The aiming sight according to the present invention can be mounted on the distal or proximal end of the barrel of a firearm. The aiming sight can be used as a single aiming sight, and can have a backup of additional regular sight.

Now, with specific reference to the figures in detail, it is emphasized that the particulars shown are by way of example and for the purpose of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail then is necessary for a fundamental understanding of the invention, the description taken with the drawings making apparent to those skilled in the art of how the several forms of the invention may be embodied in practice.

The invention can be implemented for all kinds of firearms such as rifles, pistols, grenade launchers, paintball guns or even toy guns; in fact any means which are intended to shoot real or dummy projectiles at any target.

BRIEF DESCRIPTION OF THE DRAWINGS

FIG. 1 is a perspective view of a handgun with an embodiment of an aiming sight according to the present invention.

FIG. 2A is a perspective view of the aiming sight of FIG. 1.

FIG. 2B is a horizontal cross section of FIG. 2A.

FIG. 2C is a side view of FIG. 2A.

DETAILED DESCRIPTION OF THE INVENTION

Figure 3:
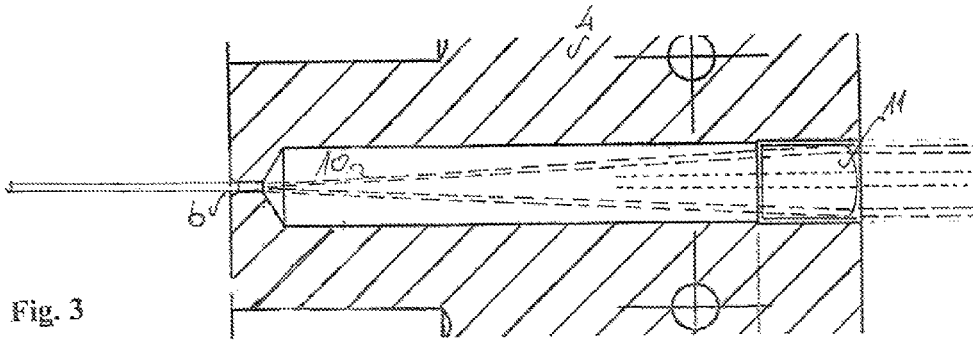
FIG. 3 is an enlarged horizontal view of FIG. 2A.

FIG. 1 describes a handgun 1 including an aiming sight 2 according to the present invention, mounted on the distal end of a firearm barrel 3. The aiming sight of the present invention can be mounted on the proximal end of the barrel as well as on different sorts of firearms, such as rifles and shot guns, for example.

In FIG. 2A there is seen metal base 4 of the sight 2, and plastic transparent part 5, accommodating light gathering fiber 6.

Metal base 4 and plastic rear part 5 can be aligned by screws (not seen) inserted in drill holes 7 and 8 as can be seen in FIGS. 2B and 2C. Light gathering fiber 6 will thus be situated at the center of a larger drill hole 9, which accommodates the multi-focal lens 11, shown in FIG. 3.

Figure 3A:
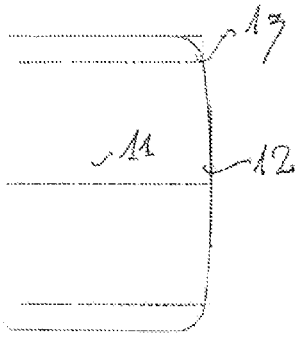
FIG. 3A is a cross section of a particular example of a multi focal lens of the present aiming sight.

FIG. 3 is an enlarged horizontal cross section of the sight 2, showing the optical effect of the multi-focal sight. Metal base 4 is drilled to accommodate multi-focal lens 11, aligned with light gathering fiber 6. The front face of multi-focal lens 11 is divided into two main portions, as can be better seen in the numerical example of FIG. 3A: a central portion 12 having a given focal length and a peripheral portion 13, having a different focal length. In the given illustrating example the central radius of curvature is approximately 18 mm, and the peripheral radius is approximately 0.5 mm. In other words, while the peripheral focal length falls on the shining edge of fiber 6 (see dotted lines 10 in FIG. 3), the focal length of the central portion 12 falls beyond the edge of fiber 6. The visual result of this lens 11 can be observed in the front view of FIG. 4 as a shining dot 17, and peripheral shining corona 14.

Figures 4A, 4B, 4C:
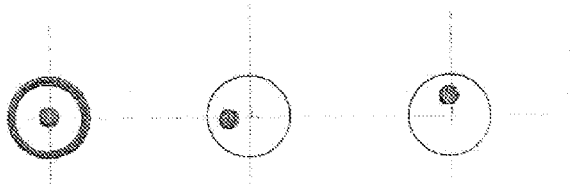
FIGS. 4A-4C illustrate the light signals displayed to the shooter, respectively, wherein the multi focal lens is aligned with the firearm; wherein the lens deviates to the left; and wherein the lens deviates upwards.
Figure 4:
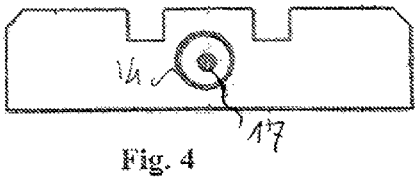
FIG. 4 is a rear view of the present aiming sight showing a light signal displayed on the multi focal lens.

FIGS. 4A-4C respectively illustrate the light signal when the longitude axis of the multi focal lens are aligned with the shooter's eye sight; when the lens axis deviates to the left; and when the lens axis deviates upwards.

Various optical choices are available for the designer of the present aiming sight. The central (shining) dot 17 can be minimized or magnified according to the focal distance of the central portion 12. The peripheral portion 13 can be chosen as curved or planner surface in order to achieve an abrupt or gradual disappearing of the corona.

The illustrated shape of the lens 11 is a round one but other shapes, such as elliptic or rectangular one can be used as well.

The form of the base mount can be differently shaped according to the firearm or the requirements of the shooter.

The procedure of acquiring the target, according to this method, includes two consecutive steps:

Directing the central dot 17 on the target.

Locating the light corona 14 around the central dot 17.

As the focal point of central portion 12 is way beyond the edge of fibers 6, the central dot 17 is easily perceived by the shooter, even when the sight is not perfectly aligned with the eye sight. Because the focal point of the central portion 12 falls on the edge of fibers 6, a perfectly collimated corona attains the shooter's eye, when the gun 1 is perfectly aligned with the shooter's eyesight.

The aiming sight according to the present invention thus fulfills the two ideal basic requirements:

1. Rapid target acquisition.
2. Accurate indication of the shooter's eye sight.

Figure 5:
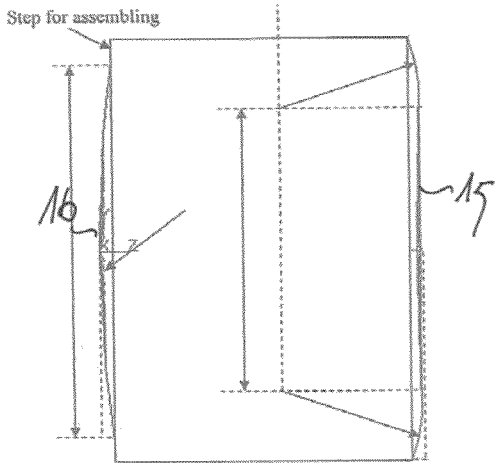
FIG. 5 is a second, improved parallax lens.

FIG. 5 shows an improved design of the parallax lens, in which the front face 18 of the lens is slightly concave and the rear face 16 is slightly convex. As a result, images of the dot 17 and its corona can be observed in deviating angles somewhat broader than the lens of FIG. 3A.

Figure 5A:
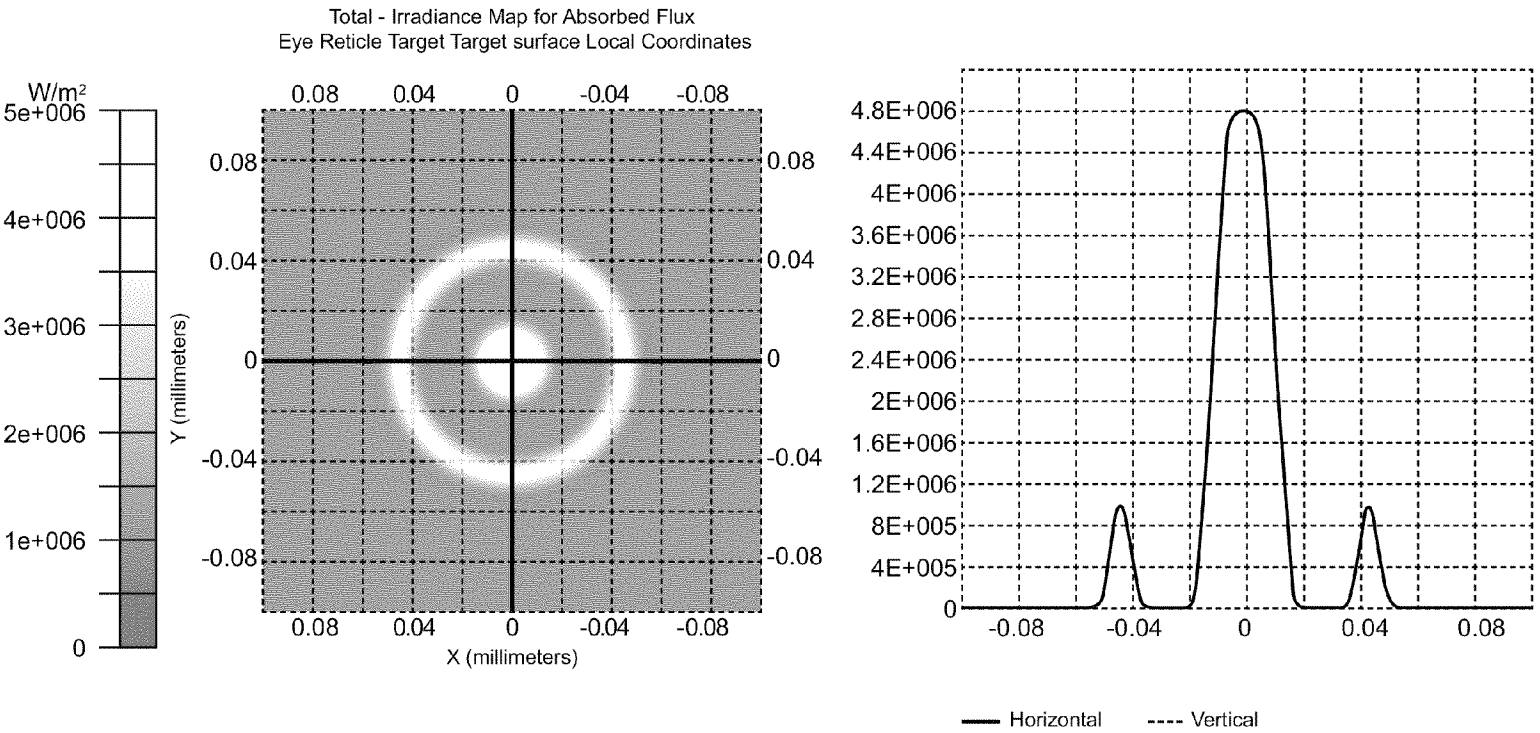
FIGS. 5A-5C are simulated distributions on an eye reticule with the lens of FIG. 5.

FIG. 5A shows a simulated distribution on an eye reticule when the aiming sight is perfectly aligned with the target. One can observe a higher luminance at the center and a perfect corona around it.

Figure 5B:
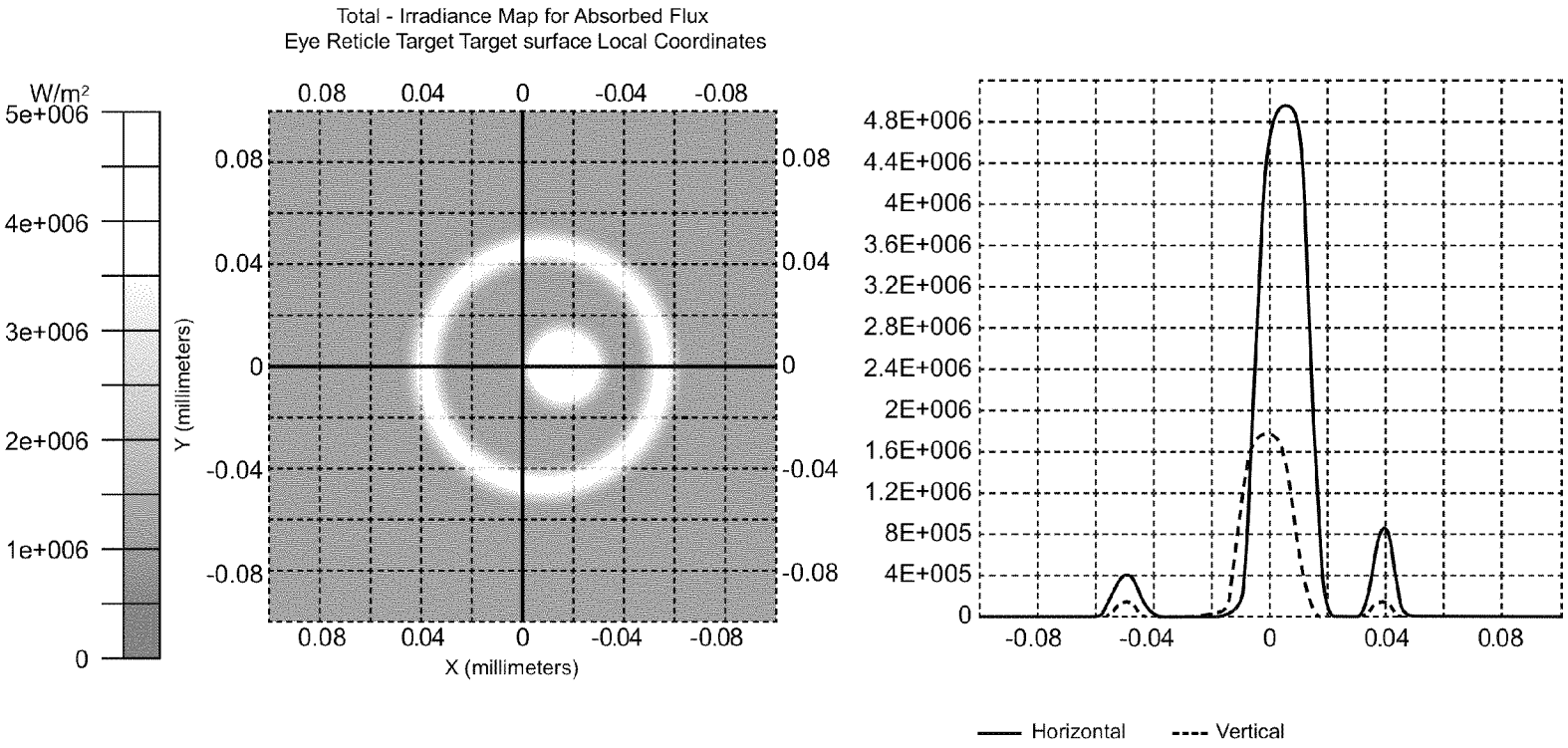

FIG. 5B illustrates a shift of 0.5 degree wherein the dot 17 is displaced towards the right.

Figure 5C:
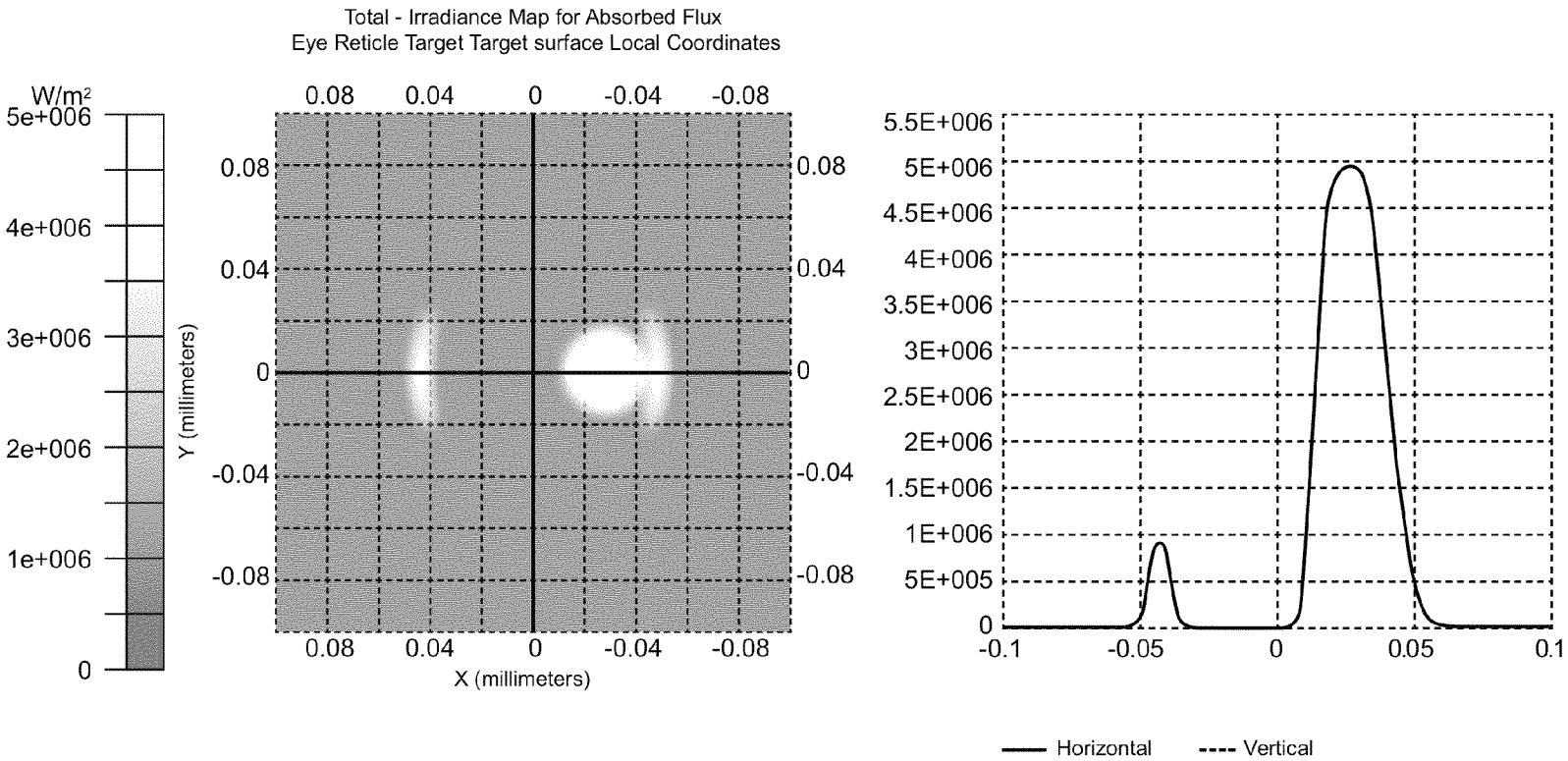

FIG. 5C illustrates a shift of 1.0 degree, wherein the dot 17 is displaced towards the right and the corona is partially damaged.

The present invention is particularly advantageous for short sighted shooters, especially when the sight is mounted on the distal end of the barrel. In that case the shooter has to focus his eye on two far landscapes only—the sight and the target, whereas in the traditional spaced apart sights, the shooter needs to clearly perceive the proximal sight in addition to the first two landscapes, which is very difficult for short sighted shooters who are unable to focus their eyes on both near and far objects.

The light gathering fiber 6, which is meant to collect ambient light, can also absorb artificial light from sources such as radioactive Tritium vials 15 (seen in FIG. 2B) embedded along the fiber's axis. The sight, according to the present invention, can function in day and night time according to the same optical principles.

What is claimed is:

1. An aiming sight for a firearm comprising:

a mounting unit;

a light gathering fiber; and a parallax multi-focal lens, wherein when aimed at a target said aiming sight displays to a shooter a complex light signal comprising a central dot and a peripheral corona around the dot.

2. The aiming sight of claim 1, wherein a parallax relationship exists between the central and the periphery zones of the lens in a way that a deviation in the alignment of the aiming means from the line of sight results in a geometrical change of the central dot or the peripheral corona.

3. The aiming sight of claim 1, wherein said multi-focal lens comprises a peripheral portion and a central portion, the focal point of the peripheral one being substantially equal to the distance between the lens and the proximal edge of said fiber, and the focal point of the central portion is substantially greater than the first one.

4. The aiming sight of claim 1, further comprising a juxtaposed radioactive inner source of light, illuminating said light gathering fiber.

5. The aiming sight of claim 1, wherein the shape of said lens is chosen out of polygons, circles or ellipses.

* * * * *